US007367840B2

(12) United States Patent
Chen et al.

(10) Patent No.: US 7,367,840 B2
(45) Date of Patent: May 6, 2008

(54) RF MICROWAVE CONNECTOR FOR TELECOMMUNICATION

(75) Inventors: Sung-Wen Chen, Hsin-Tien (TW); Tung-Liang Huang, Hsin-Tien (TW); Yu-Chu Lee, Hsin-Tien (TW)

(73) Assignee: Insert Enterprise Co., Ltd., Taipei Hsien (TW)

( * ) Notice: Subject to any disclaimer, the term of this patent is extended or adjusted under 35 U.S.C. 154(b) by 0 days.

(21) Appl. No.: 11/519,230

(22) Filed: Sep. 12, 2006

(65) Prior Publication Data

US 2008/0014792 A1 Jan. 17, 2008

(30) Foreign Application Priority Data

Jul. 14, 2006 (TW) ..... 95212407 U

(51) Int. Cl.
*H01R 9/05* (2006.01)

(52) U.S. Cl. ..... 439/581; 439/578; 439/584

(58) Field of Classification Search ..... 439/581, 439/578, 584, 585, 63
See application file for complete search history.

(56) References Cited

U.S. PATENT DOCUMENTS 5,180,315 A * 1/1993 Nagashima ..... 439/581
5,190,474 A * 3/1993 Ginet ..... 439/581
5,263,877 A * 11/1993 Mitani ..... 439/585
5,569,049 A * 10/1996 Tatebe et al. ..... 439/394
5,662,480 A * 9/1997 Togashi ..... 439/63
5,772,470 A * 6/1998 Togashi ..... 439/582
5,772,472 A * 6/1998 Beutler et al. ..... 439/608
5,879,190 A * 3/1999 Maruyama et al. ..... 439/582
6,074,217 A * 6/2000 Maruyama et al. ..... 439/63
D447,117 S * 8/2001 Ko ..... D13/133
6,361,383 B1 * 3/2002 Ko ..... 439/856
D457,496 S * 5/2002 Ko ..... D13/133
6,435,909 B1 * 8/2002 Ko ..... 439/585
6,447,335 B1 * 9/2002 Ko ..... 439/585
6,503,100 B2 * 1/2003 Yamane ..... 439/582
6,508,668 B1 * 1/2003 Yamane ..... 439/582
6,533,610 B1 * 3/2003 Dai et al. ..... 439/581
6,712,645 B1 * 3/2004 Chou ..... 439/582
6,739,907 B2 * 5/2004 Kuroda et al. ..... 439/582
6,790,082 B2 * 9/2004 Obayashi ..... 439/582
6,808,417 B2 * 10/2004 Yoshida ..... 439/585
6,916,201 B1 * 7/2005 Chu ..... 439/582
6,971,913 B1 * 12/2005 Chu ..... 439/582
6,997,745 B2 * 2/2006 Ikeda ..... 439/582
7,025,598 B2 * 4/2006 Ikeda ..... 439/63
7,025,631 B2 * 4/2006 Yamane ..... 439/582
7,186,142 B2 * 3/2007 Nagata et al. ..... 439/582
7,204,715 B2 * 4/2007 Kukita ..... 439/582

* cited by examiner

*Primary Examiner*—Renee Leubke
*Assistant Examiner*—Vanessa Girardi
(74) *Attorney, Agent, or Firm*—Troxell Law Office, PLLC

(57) ABSTRACT

A RF microwave connector for telecommunication has a central terminal with a guiding groove and a fixing groove. The diameter of the cross section of the guiding groove is larger than the diameter of an inner wire of a coaxial cable and the diameter of the cross section of the upper end of the fixing groove is smaller than the diameter of the inner wire. The inner wire is thrust in the fixing groove by the walls of the fixing groove to cause the combination of the central terminal and the inner wire to be more stable and the connector to have better signal transmission quality by thrusting the inner wire into the fixing groove.

4 Claims, 8 Drawing Sheets

325
321
32
322
324
323
31
44
40

34
33
36
35
312
43
311
42
41

313

RF MICROWAVE CONNECTOR FOR TELECOMMUNICATION

BACKGROUND OF THE INVENTION

1. Field of the Invention

The present invention relates to an electric connector, and more particularly to a radio frequency microwave connector for telecommunication.

2. Description of Related Art

Taiwan Patent No. M271,298 and the corresponding U.S. patent application Ser. No. 11/037,201 entitled with "RF microwave connector for telecommunication" applied by the applicant of the present invention discloses a RF microwave connector for telecommunication comprising a female terminal in which the female terminal has a main body. Two face-to-face contact sheets used for clamping a male terminal are respectively extended from two sides of one end of the main body and an arc-shaped clamping section is disposed on another end of the main body. Whereby, two edges of the clamping section are allowed to bend oppositely smoothly to clamp an inner wire of a coaxial cable firmly in the operation of combining the clamping section with the inner wire.

Another Taiwan Patent No. M276,372 and the corresponding U.S. patent application Ser. No. 11/115,108 entitled with "RF microwave connector for telecommunication" applied by the applicant of the present invention discloses a RF microwave connector for communication comprising a male terminal in which the male terminal has a main body. A projecting portion used for inserting in a female terminal is extended from on end of the main body and an arc-shaped clamping section is disposed on another end of the main body. Two edges of the clamping section are symmetrically curvedly bended. Whereby, two edges of the clamping section are allowed to bend oppositely smoothly to clamp an inner wire of a coaxial cable firmly in the operation of combining the clamping section with the inner wire.

When a connector disclosed in either of both Taiwan patents is used, the female terminal or the male terminal is first caused to combine with a coaxial cable and then combine with a plastic insulator and a metal housing. Such kind of two-steps processing way rather wastes time and increases the production probability of flawed products.

Please refer to FIGS. 1A, 1B and 1C. A manufacturing method of a conventional connector comprises allowing an insulator 11 to combine with a central terminal in a hollow portion thereof. A groove 111 and an upward extended and bendable sheet 112 are disposed on the upper end of the insulator 11. A first clamping sheet 121 and a second clamping sheet 122 are connected with the central terminal at the upper end thereof. The first clamping sheet 121 is mounted in the groove 111 of the insulator 11. One end of the second clamping sheet 122 is connected with one end of the first clamping sheet 121 and another end of the second clamping sheet 122 is installed above the first clamping sheet 121. Moreover, a metal housing 13 is allowed to combine with the insulator 11. A buckling part 131 is combined with the metal housing 13 at one side thereof. Multiple pairs of tags 132, 133, 134 and 135 respectively disposed toward two sides of the buckling part 131 are disposed thereon as FIG. 1A shows. Furthermore, an inner wire 21 of a coaxial cable 20 is allowed to mount in the groove 111 and installed beyond the first clamping sheet 121. An inner insulation layer 22, grounding wire layer 23 and outer insulation layer 24 of the coaxial cable are respectively outside the groove 111 as FIG. 1B shows.

Furthermore, the clamping part 131 is bended 90 degree to draw toward the rim of the upper end of the metal housing 11 to cause the inner wire 21 to be sandwiched between the second clamping sheet 122 and the first clamping 121 and the sheet 112 is pressed against the upper side of the second clamping sheet 122 to allow the second clamping sheet 122 not to contact with the buckling part 131. Next, the sheet pairs 132, 133, 134 and 135 are further bended to cause the sheet pairs 132 and 133 to fasten the metal housing 11 and the sheet pares 134 and 135 respectively to fasten the grounding wire layer 23 and the outer insulation layer 24 as FIG. 1C shows.

According to the assembling manner of the connector mentioned above, the coaxial cable 20 and the central terminal are together caused to combine with each other when the buckling part 131 is bended; it is time saving. But, the structure only utilizing the first clamping sheet 121 and the second clamping sheet 122 to clamp the inner wire 21 is rather not stable; it will influence the signal transmission quality. Besides, if an improper pull force is exerted on the coaxial cable when the connector is used, it is rather loosed easily.

SUMMARY OF THE INVENTION

For improving the combination structure of a central terminal of a RF microwave connector for telecommunication and an inner wire of a coaxial cable to allow the manufacturing to be more convenient and time saving and decrease the manufacturing defective fraction of product, the present invention is proposed.

The main object of the present invention is to provide a RF microwave connector for telecommunication, allowing the combination manufacturing between a central terminal of the connector and an inner wire of a coaxial cable to be easier and more time saving.

Another object of the present invention is to provide a RF microwave connector for telecommunication, allowing a central terminal of the connector and an inner of a coaxial cable to be more closely combined and not to be loosed so as to increase the yield factor.

BRIEF DESCRIPTION OF THE DRAWINGS

The present invention can be more fully understood by reference to the following description and accompanying drawings, in which:

FIG. 6C' is a schematic view, showing a state that a upper end part and lower end part of a central terminal shown in FIG. 6C are separated;

DETAILED DESCRIPTION OF THE PREFERRED EMBODIMENTS

Figures 1A, 1B, 1C:
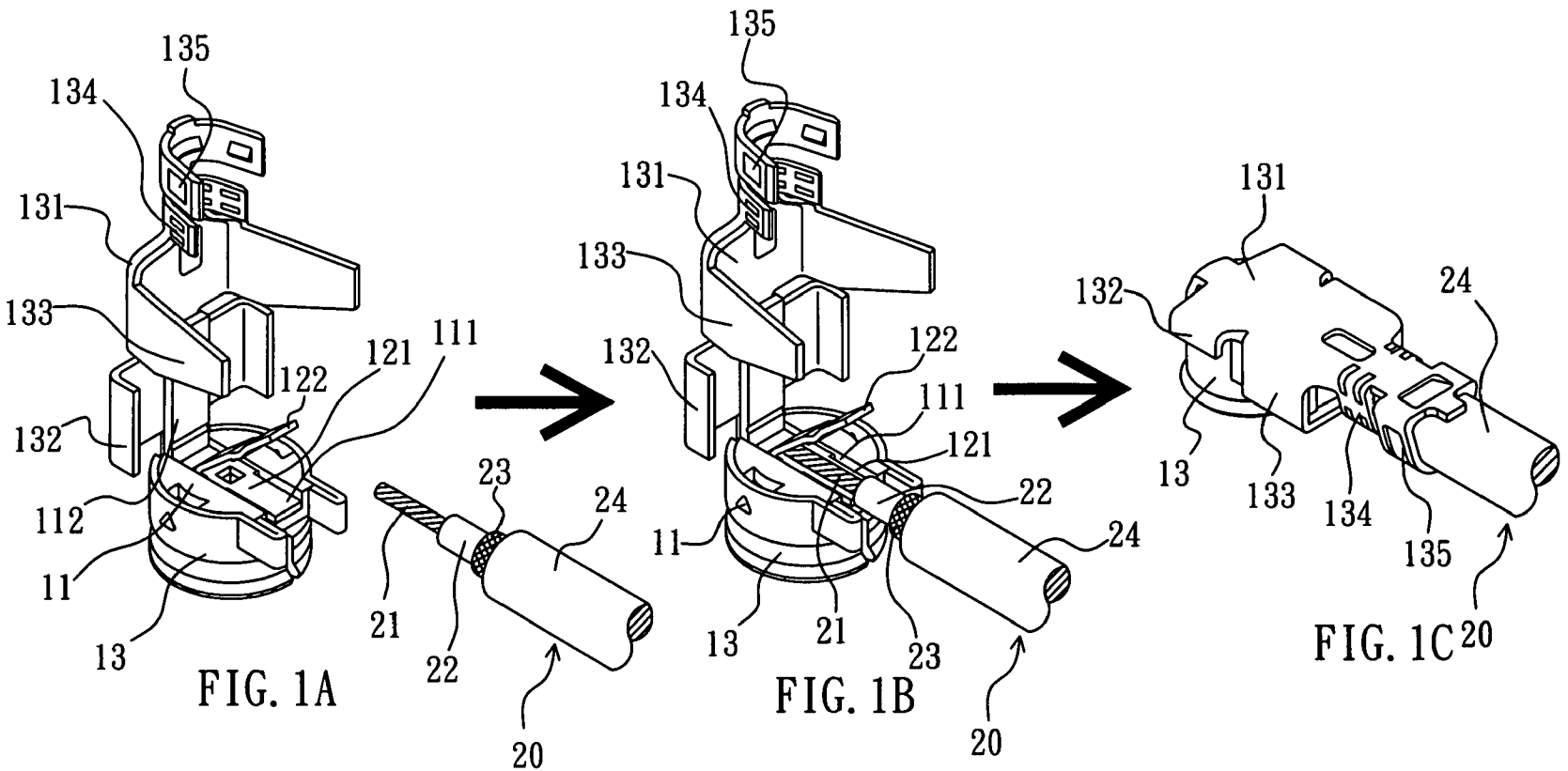
FIGS. 1A, 1B and 1C are schematic views showing assembly procedures of a conventional connector.
Figure 2:
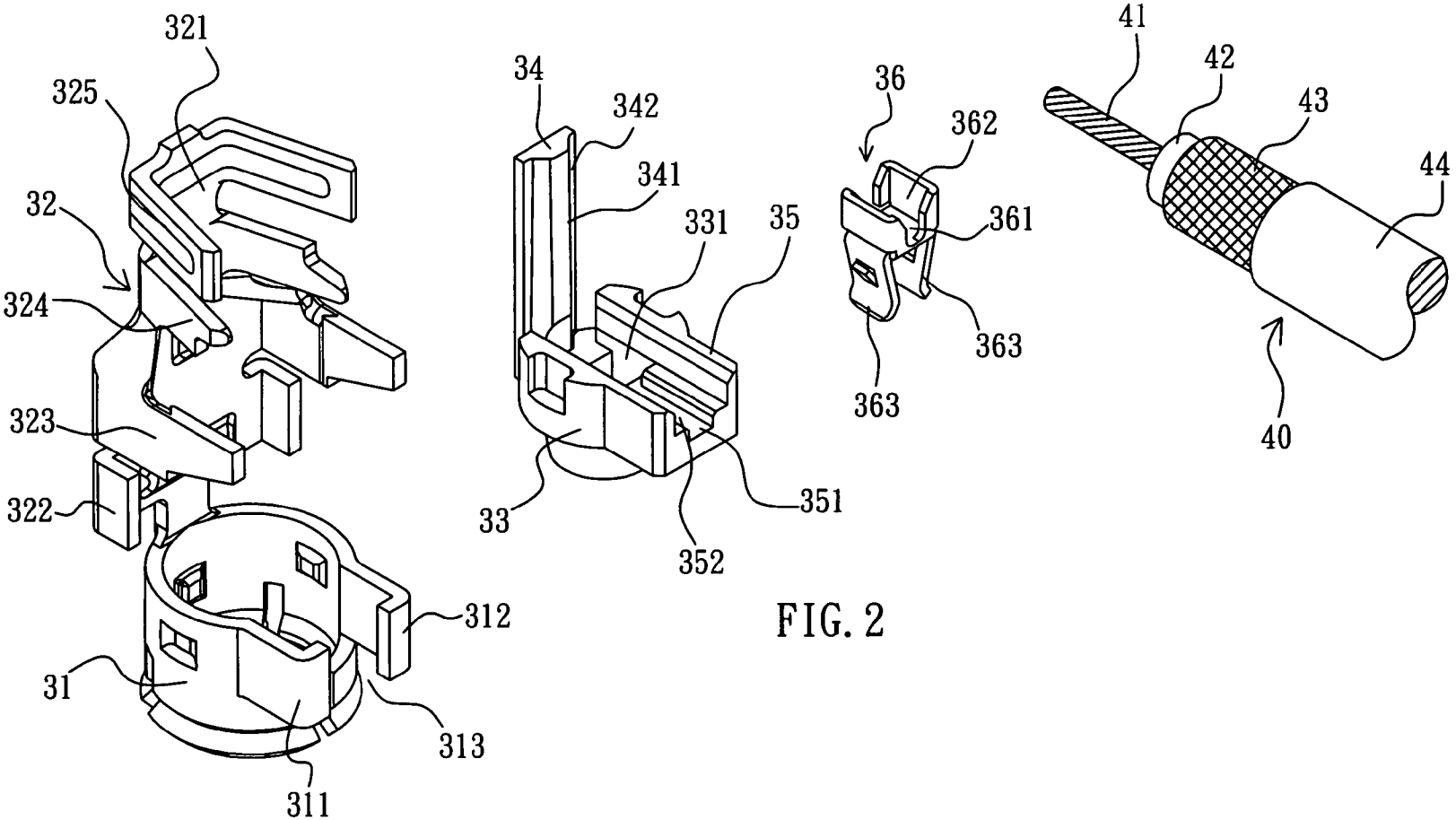
FIG. 2 is an exploded view, showing components of a connector of a first preferred embodiment according to the present invention and a coaxial cable.
Figures 3A, 3B, 3C:
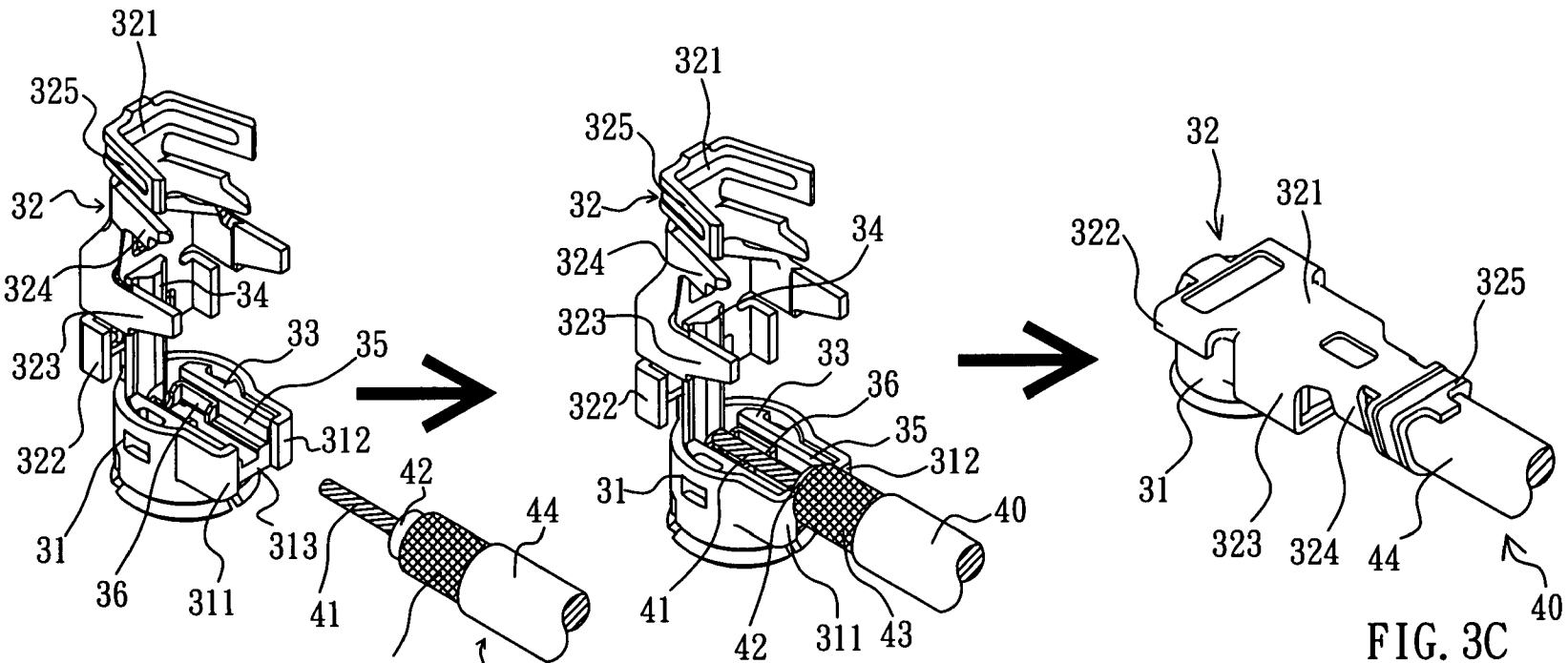
FIGS. 3A, 3B and 3C are perspective views, showing assembly procedures of a connector of the present invention.
Figures 4A, 4B, 4C:
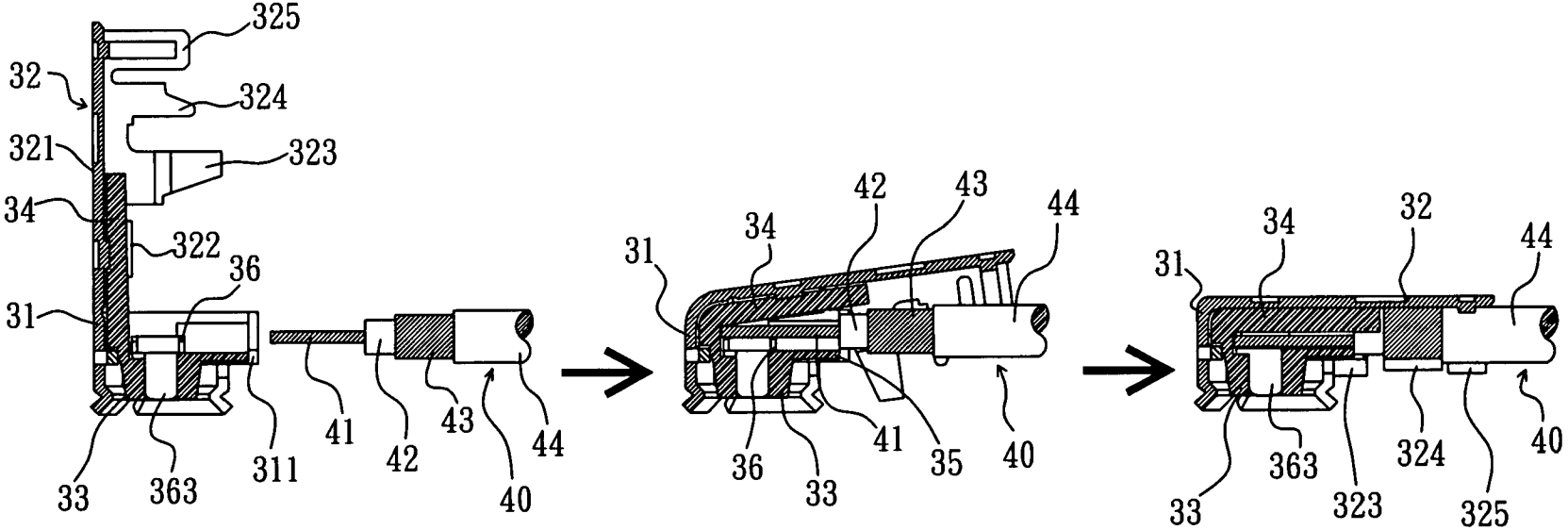
FIGS. 4A, 4B and 4C are cross sectional views, showing assembly procedures of a connector of the present invention.

Please refer to FIGS. 2, 3A to 3C, 4A to 4C, 5A and 5B. A RF microwave connector for telecommunication according to the present invention is used for allowing the manufacturing of the connector to be more time saving and a central terminal and an inner wire of a coaxial cable to be more tightly combined; a connector of a first preferred embodiment according to the present invention comprises a metal housing 31, a plastic insulator 33 and a central terminal 36. A combination part 32 is extended upward from the upper end of the metal housing 31. The combination part 32 with an intermediate element 321 and a first tag pair 322, second tag pair 323, third tag pair 324 and fourth tag pair 325 are extended outward from two sides of the intermediate element 321. One pair of L-shaped arms 311 and 312 extended outward at the opposite sides of the combination part 32 is disposed on the metal housing 31 and an interval 313 exists between the L-typed arms 311 and 312. Furthermore, the plastic insulator 33, which has a hollow portion 331, is covered in the metal housing 31. A bendable sheet 34 extended upward and a projection 35 extended outward levelly are disposed on the upper end of the plastic insulator 33; the projection 35 is placed between the L-shaped arms 311 and 312 and the sheet 34 is disposed on the corresponding side of the projection 35. A first groove 351 and a second groove 352 communicated with each other are disposed on the projection 35. The diameter of the cross section of the second groove 352 is larger than the one of the first groove 351 and the second groove is positioned above the first groove 351. The sheet 34 has a first projecting part 341 and a second projecting part 342 respectively corresponding to the first groove 351 and the second groove 352. The central terminal 36 is covered in the hollow portion 331 of the plastic insulator 33. A fixing groove 361 and a guiding groove 362 communicated with each other are disposed on the upper end of the central terminal 36; the guiding groove 362 is positioned above the fixing groove 361. Two opposite contact plates 363 used for clamping a male terminal are disposed on the lower end of the central terminal 36 as FIGS. 3A and 4A show.

Figure 5B:
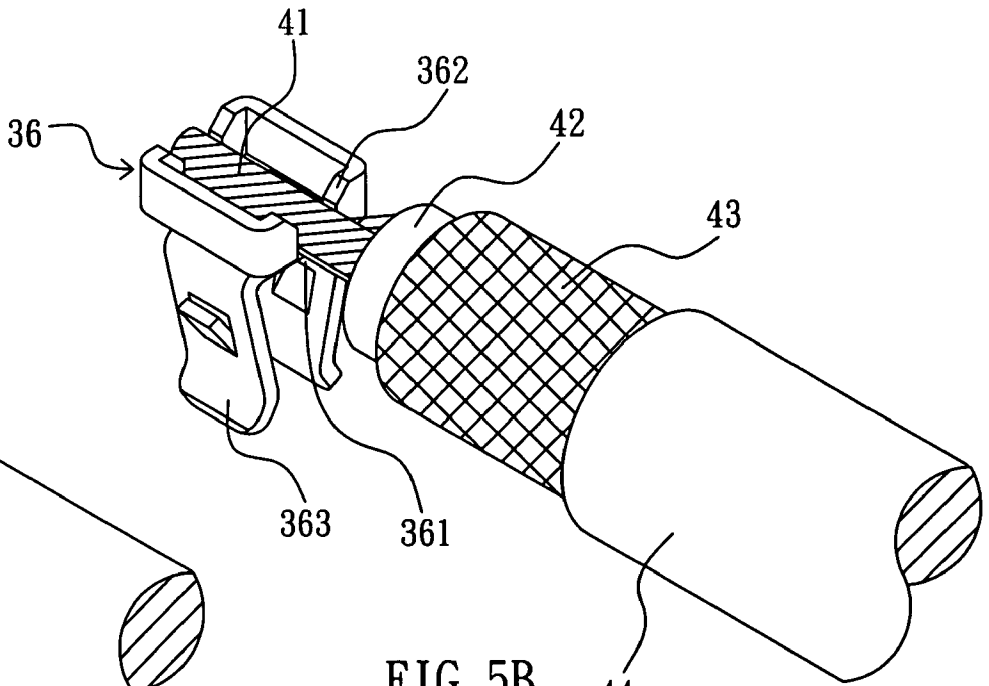
FIG. 5B is a perspective view, showing that a fixing groove of a central terminal of the present invention is covered with an inner wire of a coaxial cable.
Figure 5A:
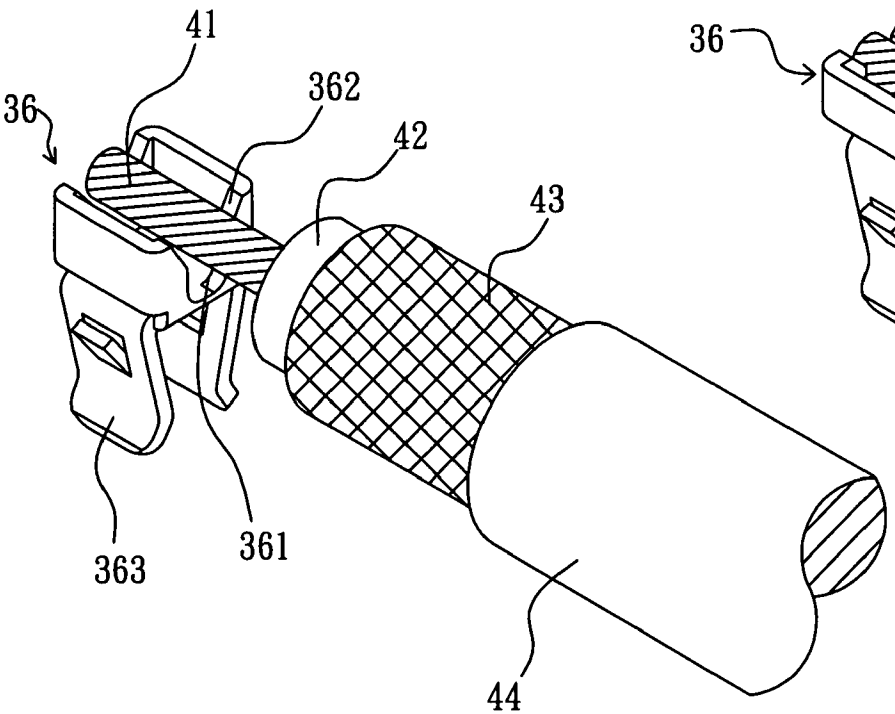
FIG. 5A is a perspective view, showing that a guiding groove of a central terminal of the present invention is covered with an inner wire of a coaxial cable.

Here, the diameter of the cross section of the guiding groove 362 of the central terminal 36 is larger than the one of an inner wire 41 of a coaxial cable 40 and the diameter of the cross section at the upper end of the fixing groove 361 is smaller than the one of the inner wire 41 so as to allow the combination part 32 to be bended to cause the sheet 34 to be bended downward to press the inner wire 41 to cause it to be thrust into the fixing groove 361 as FIG. 5B shows and allow the second projecting part 342 and the first projecting part 341 of the insulating sheet 34 to be respectively placed in the second groove 352 and the first groove 351 and be suppressed above the inner wire 41 to cause the inner wire 41 and the combination part 32 not to contact with each other after the inner wire 41 is placed in the guiding groove 362 of the central terminal 36 and the first groove 351 and the inner insulation layer 42 of the coaxial cable 40 is placed between the L-shaped arms 311 and 312 and extended to the outside of the L-shaped arms 311 and 312 as FIGS. 3B, 4B and 5A show. In the meantime, the first tag pair 322, the second tag pair 323, the third tag pair 324 and the fourth tag pair 325 are respectively caused to buckle the upper end of the outside of the metal housing 31, the outsides of the L-shaped arm 311 and 312, the grounding wire layer 43 and the outer insulation layer 44 of the coaxial cable 40 as FIGS. 3C and 4C show.

The inner wire 41 of the coaxial cable 40 is thrust to enter the fixing groove 361 of the central terminal 36 according to the present invention to cause the inner wire 41 in the fixing groove 361 to be thrust by the walls of the fixing groove 361 to allow the combination of the central terminal 36 and the inner wire 41 to be more stable and the better signal transmission quality to be obtained, and if the coaxial cable 40 is exerted with an improper pull force when the connector is in use, the inner wire 41 is rather not allowed to depart from the central terminal 36.

Figure 6E:
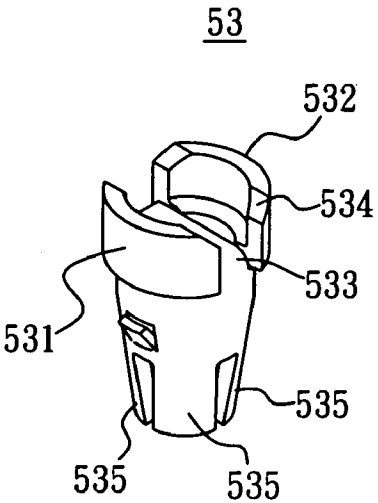
FIGS. 6A to 6E are schematic views. Respectively showing each of various different shapes of central terminals according to the present invention.
Figure 6D:
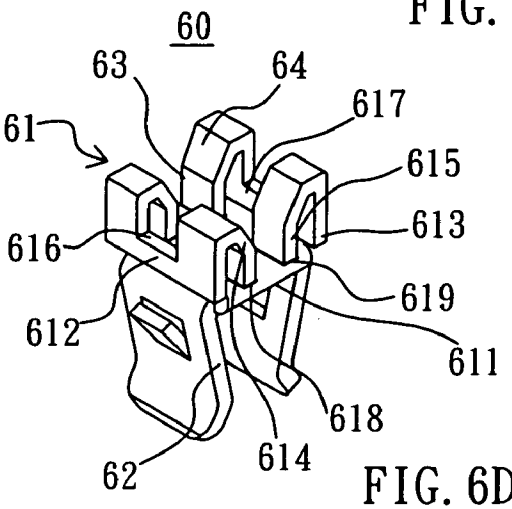
Figure 6C:
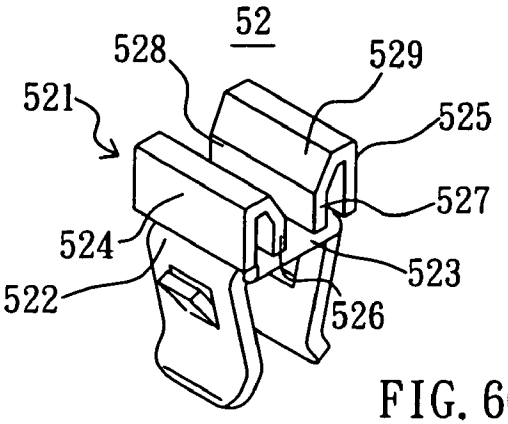
Figure 6C:
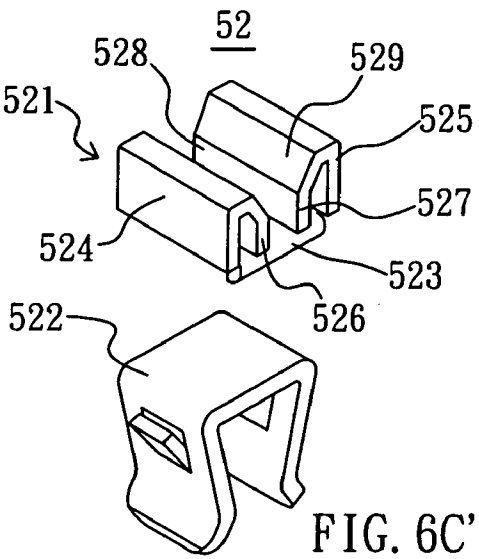
Figure 6A:
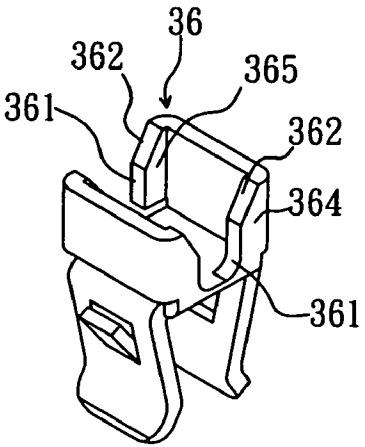

Please refer to FIGS. 6A to 6E. A central terminal can have a variety of shape changes, for example:

A first wall 364 and a second wall 365 face to face are disposed at the upper end of the central terminal 36; the first wall 364 and the second wall 365 respectively have a fixing groove 361 and a guiding groove 362 communicated with each other as FIG. 6A shows.

Figure 6B:
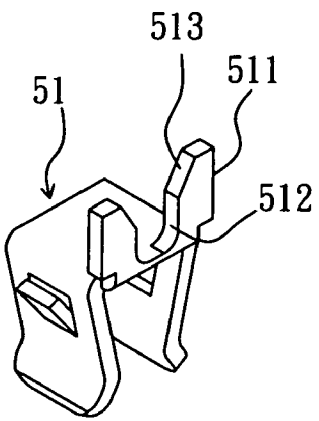

A wall 511 is disposed at the upper end of a central terminal 51. The wall 511 has a fixing groove 512 and a guiding groove 513 communicated with each other as FIG. 6B shows.

A central terminal 52 consists of a upper end part 521 and a lower end part 522, the upper part 521 is located at the top of the lower end part 522; the upper end part 521 has a bottom sheet 523, a first sheet 524 and a second sheet 525. The first sheet 524 and the second sheet 525 are respectively extended upward from the two opposite sides of the bottom sheet 523, and the end parts of the first sheet 524 and the second sheet 525 are respectively bended downward to form a first wall 526 and a second wall 527. a fixing groove 528 and a guiding groove 529 communicated with each other and respectively having a certain depth are formed at a space between the first wall 526 and the second wall 527 as FIGS. 6C and 6C' show.

A central terminal 60 consists of an upper end part 61 and a lower end part 62, the upper part 61 is located at the top of the lower end part 62; the upper end part 521 has a bottom sheet 611, a first sheet 612 and a second sheet 613. The first sheet 612 and the second sheet 613 are respectively extended upward from the two opposite sides of the bottom sheet 611, and the end parts of the first sheet 612 and the second sheet 613 are respectively bended downward to form a first wall 614 and a second wall 615. Notches 616 and 617 respectively extended up to the end parts of the first wall 614 and the second wall 615 are respectively disposed in the middles of the first sheet 612 and the second sheet 613. The bottom sheet 611 has holes 618 and 619 respectively allowing the bottoms of the first wall 614 and the second wall 615 to be passed through. A fixing groove 63 and a guiding groove 64 communicated with each other and having a certain depth are formed at a space between the first wall 614 and the second wall 615 as FIG. 6D shows. A sheet of a plastic insulator can further have tenons respectively corresponding to the notches 616 and 617; the tenons are used to engage into the notches to allow the sheet of the insulator and the central terminal to be combined with each other more stably.

Two opposite arc-shaped first wall 531 and second wall 532 are disposed at the upper end of a central terminal 53 and a fixing groove 533 and a guiding groove 534 communicated with each other are formed between the end parts of the first wall 531 and the second wall 532. A plurality of arc-shaped contact sheets 535 used for clamping a male terminal are disposed at the lower end of the central terminal 53 as FIG. 6E shows.

Figures 7A, 7B:
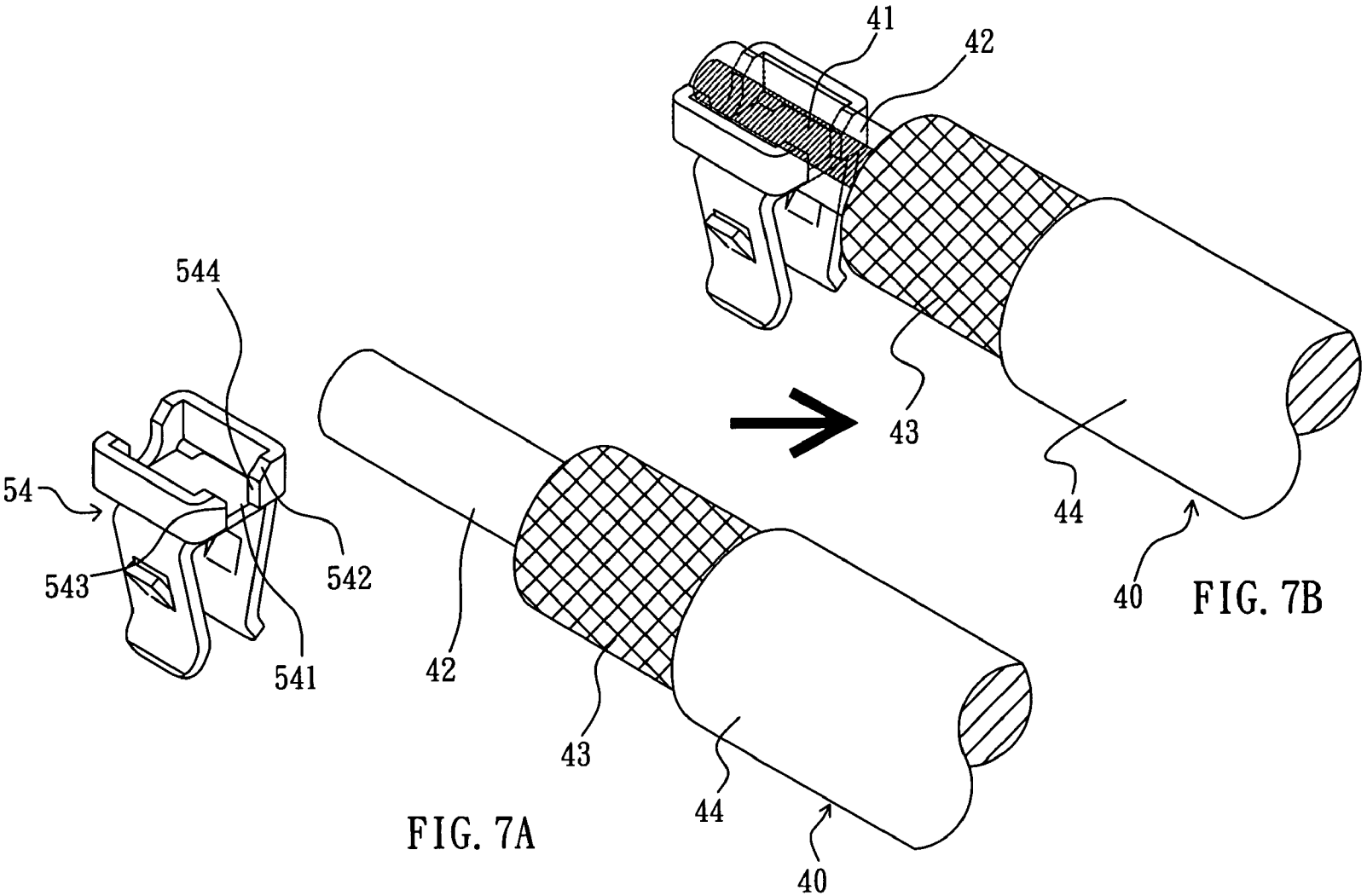
FIG. 7A is a perspective view, showing that a guiding groove of a central terminal of the present invention is not covered with a outer insulation layer of a coaxial cable.
FIG. 7B is a perspective view, showing a fixing groove of a central terminal of the present invention is combined with an inner wire of a coaxial cable.

Please refer to FIGS. 7A and 7B. A fixing groove 541 and a guiding groove 542 are disposed at the upper end of a central terminal 54 according to the present invention, in which walls 543 and 544 at two sides of the fixing groove 541 are sharp. When the inner insulation layer 42 used for covering an inner wire 41 is thrust to move inward the fixing groove of the central terminal 54, it can be cut off by the walls 543 and 544 and the inner wire 41 thrust in the fixing groove 541 can be exposed as FIG. 7B. Whereby, the work for cutting off the inner insulation layer 42 of the coaxial cable 40 to cause the inner wire 41 to be exposed can be omitted.

Figure 8B:
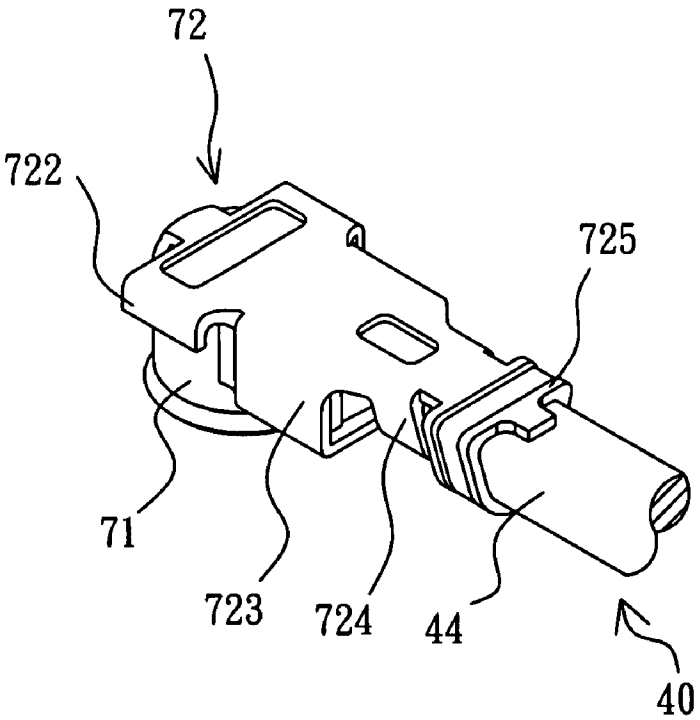
FIG. 8B is a perspective view, showing a connector of a second preferred embodiment according to the present invention is combined with a coaxial cable.
Figure 8A:
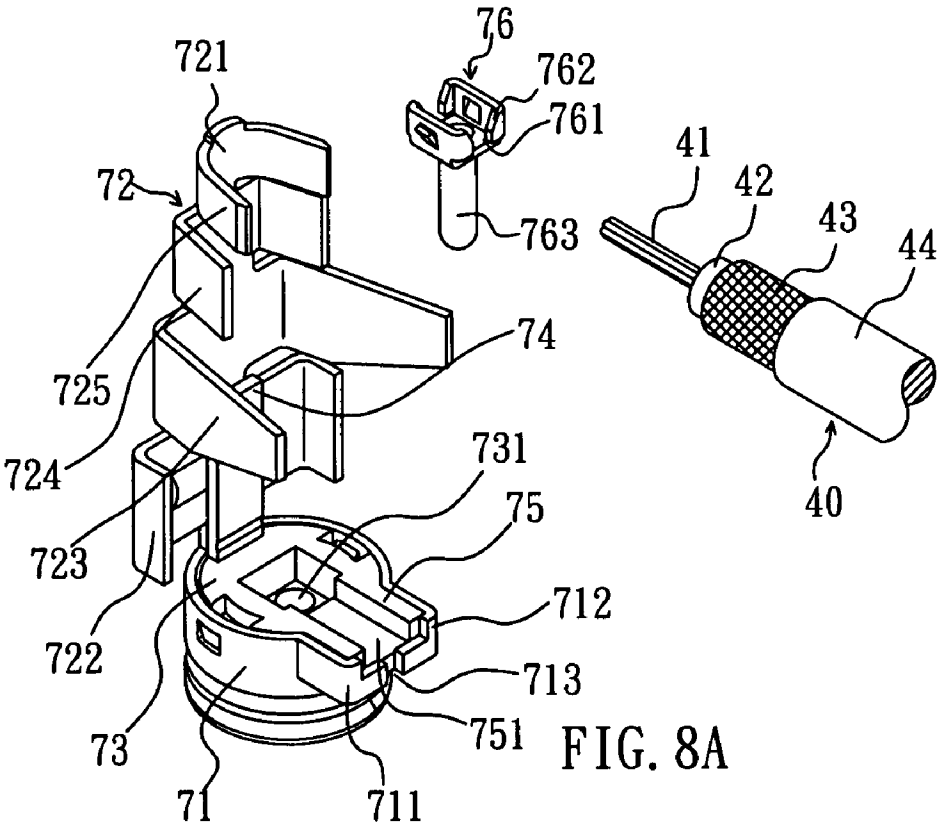
FIG. 8A is an exploded view, showing components of a connector of a second preferred embodiment according to the present invention and a coaxial cable.

Please refer to FIGS. 8A and 8B. A RF micro connector for telecommunication of a second preferred embodiment according to the present invention comprises a metal housing 71, a plastic insulator 73 and a central terminal 76. a combination part 72 in which an intermediate element 721 is disposed and a first tag pair 722, second tag pair 723, third tag pair 724 and fourth tag pair 725 are extended outward from two sides of the intermediate element 721 is extended upward from the upper end of he metal housing 71. One pair of L-shaped arms 711 and 712 extended outward at the opposite sides of the combination part 72 is disposed on the metal housing 71 and an interval 713 exists between the L-typed arms 711 and 712. Furthermore, the plastic insulator 73, which has a hollow portion 731, is covered in the metal housing 71. A bendable sheet 74 extended upward and a projection 75 extended outward levelly are disposed on the upper end of the plastic insulator 73; the projection 75 is placed between the L-shaped arms 711 and 712 and the sheet 74 is disposed on the corresponding side of the projection 75. The projection 75 has a groove 751 corresponding to the sheet 74. The central terminal 76 is covered in the hollow portion 731 of the plastic insulator 73. A fixing groove 761 and a guiding groove 762 communicated with each other are disposed on the upper end of the central terminal 76; the guiding groove 762 is positioned above the fixing groove 761. A circular-stick-typed male terminal 763 used for being clamped between two contact sheets of a female terminal is disposed on the lower end of the central terminal 76. Here, the diameter of the cross section of the guiding groove 762 of the central terminal 76 is larger than the one of an inner wire 41 of a coaxial cable 40 and the diameter of the cross section at the upper end of the fixing groove 761 is smaller than the one of the inner wire 41 so as to allow the combination part 72 to be bended to cause the sheet 74 to be bended downward to press the inner wire 41 to cause it to be thrust into the fixing groove 761 and allow the lower end of the insulating sheet 74 to be placed in the groove 751 and be suppressed above the inner wire 41 to cause the inner wire 41 and the combination part 72 not to contact with each other after the inner wire 41 is placed in the guiding groove 762 of the central terminal 76 and the groove 751 and the inner insulation layer 42 of the coaxial cable 40 is placed between the L-shaped arms 711 and 712 and extended to the outside of the L-shaped arms 711 and 712. In the meantime, the first tag pair 722, the second tag pair 723, the third tag pair 724 and the fourth tag pair 725 are respectively caused to buckle the upper end of the outside of the metal housing 71, the outsides of the L-shaped arms 711 and 712, the grounding wire layer 43 and the outer insulation layer 44 of the coaxial cable 40 as FIG. 8B shows.

The inner wire 41 of the coaxial cable 40 is thrust to enter the fixing groove 761 of the central terminal 76 according to the present invention to cause the inner wire 41 in the fixing groove 761 to be thrust by the walls of the fixing groove 761 to allow the combination of the central terminal 76 and the inner wire 41 to be more stable and the better signal transmission quality to be obtained, and if the coaxial cable 40 is exerted with an improper pull force when the connector is in use, the inner wire 41 is rather not allowed to depart from the central terminal 76.

In the RF microwave connector for telecommunication of the second preferred embodiment according to the present invention mentioned above, the shape of upper end of the central terminal 76 can also be the same as the shape of the upper end of each central terminal shown in FIGS. 6A to 6D and 7A, and they have the same functions. The shape of the sheet 74 of the plastic insulator 73 corresponding to the one of the groove 751 can also be the shapes of the first projecting part 341 and the second projecting part 342 of the sheet 34 of the plastic insulator 33 respectively corresponding to the shapes of the first groove 351 and the second groove 352 as FIG. 2 shows, and they have the same functions. Here, the graphs and the description thereof are omitted.

The combination between a central terminal and an inner wire of a coaxial cable become easier, more time saving and tighter so as not to be loosed according to the present invention. Whereby, the yield factor can be increased.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A radio frequency microwave connector for telecommunication, used for allowing the manufacturing of the connector to be more time saving and a central terminal and an inner wire of a coaxial cable to be more tightly combined, comprising;

a metal housing, a combination part being extended upward from a upper end thereof, said combination part having a intermediate element and a plurality of tag pairs respectively extended outward from two sides of said intermediate element, a pair of arms extended outward at the opposite sides of said combination being disposed on said metal housing, an interval existing between said two arms;

a plastic insulator, covered in said metal housing and having a hollow portion, a bendable sheet extended upward and a projection extended outward and levelly being disposed at a upper end thereof, said projection being accented between said two arms, a groove is disposed on said projection, said sheet being corresponding to said groove;

the central terminal, covered in said hollow portion of said plastic insulator, a fixing groove and guiding groove communicated with each other being disposed at a upper end of said central terminal, said guiding groove being positioned above said fixing groove, one of a male terminal and a female terminal being disposed at a lower end of said central terminal;

wherein a diameter of a cross section of said guiding is larger than a diameter of said inner wire of said coaxial cable, a diameter of a cross section of a upper end of said fixing groove is smaller than said diameter of said inner wire; whereby, said inner wire is allowed to thrust into said fixing groove and a lower end of said insulating sheet to be placed in said groove and suppressed above said inner wire to cause said inner wire and said combination not to contact with each other when said combination part and said sheet are bended; in the meantime, said tag pairs are respectively caused to buckle said metal housing, said two arms and said a grounding wire layer and outer insulation layer of said coaxial cable, wherein a male terminal is disposed at the lower end of said central terminal, said male terminal is circular-stick-typed, wherein said central terminal comprises an upper end part and a lower end part; said upper part is positioned above said lower end part; said upper end part comprises a bottom sheet, a first sheet and a second sheet; said first sheet and said second sheet extend upward from two opposite sides of said bottom sheet; end parts of said first sheet and said second sheet are bent downward to form a first wall and a second wall respectively; a space between said first wall and said second wall forms said fixing groove and said guiding groove which communicate with each other and have certain depths.

2. A radio frequency microwave connector for telecommunication, used for allowing the manufacturing of the connector to be more time saving and a central terminal and an inner wire of a coaxial cable to be more tightly combined, comprising:

a metal housing, a combination part being extended upward from a upper end thereof, said combination part having a intermediate element and a plurality of tag pairs respectively extended outward from two sides of said intermediate element, a pair of arms extended outward at the opposite sides of said combination being disposed on said metal housing, an interval existing between said two arms;

a plastic insulator, covered in said metal housing and having a hollow portion, a bendable sheet extended upward and a projection extended outward and levelly being disposed at a upper end thereof, said projection being accepted between said two arms, a groove is disposed on said projection, said sheet being corresponding to said groove;

the central terminal, covered in said hollow portion of said plastic insulator, a fixing groove and guiding groove communicated with each other being disposed at a upper end of said central terminal, said guiding groove being positioned above said fixing groove, one of a male terminal and a female terminal being disposed at a lower end of said central terminal;

wherein a diameter of a cross section of said guiding is larger than a diameter of said inner wire of said coaxial cable, a diameter of a cross section of a upper end of said fixing groove is smaller than said diameter of said inner wire; whereby, said inner wire is allowed to thrust into said fixing groove and a lower end of said insulating sheet to be placed in said groove and suppressed above said inner wire to cause said inner wire and said combination not to contact with each other when said combination part and said sheet are bended; in the meantime, said tag pairs are respectively caused to buckle said metal housing, said two arms and said a grounding wire layer and outer insulation layer of said coaxial cable, wherein a male terminal is disposed at the lower end of said central terminal, said male terminal is circular-stick-typed, wherein said central terminal comprises an upper end part and a lower end part; said upper part is positioned above said lower end part; said upper end part comprises a bottom sheet, a first sheet and a second sheet; said first sheet and said second sheet extend upward from two opposite sides of said bottom sheet; end parts of said first sheet and said second sheet are bent downward to form a first wall and a second wall respectively; a groove hole is formed in middle parts of said first sheet and said second sheet; said two groove holes are respectively extended to end parts of said first wall and said second wall; said bottom sheet has holes for allowing bottoms of said first wall and said second wall to be respectively passed through; a space between said first wall and said second wall forms said fixing groove and said guiding groove which communicate with each other and have certain depths.

3. A radio frequency microwave connector for telecommunication, used for allowing the manufacturing of the connector to be more time saving and a central terminal and an inner wire of a coaxial cable to be more tightly combined, comprising:

a metal housing, a combination part being extended upward from a upper end thereof, said combination part having a intermediate element and a plurality of tag pairs respectively extended outward from two sides of said intermediate element, a pair of arms extended outward at the opposite sides of said combination being disposed on said metal housing, an interval existing between said two arms;

a plastic insulator, covered in said metal housing and having a hollow portion, a bendable sheet extended upward and a projection extended outward and levelly being disposed at a upper end thereof, said protection being accepted between said two arms, a groove is disposed on said projection, said sheet being corresponding to said groove;

the central terminal, covered in said hollow portion of said plastic insulator, a fixing groove and guiding groove communicated with each other being disposed at a upper end of said central terminal, said guiding groove being positioned above said fixing groove, one of a male terminal and a female terminal being disposed at a lower end of said central terminal;

wherein a diameter of a cross section of said guiding is larger than a diameter of said inner wire of said coaxial cable, a diameter of a cross section of a upper end of said fixing groove is smaller than said diameter of said inner wire; whereby, said inner wire is allowed to thrust into said fixing groove and a lower end of said insulating sheet to be placed in said groove and suppressed above said inner wire to cause said inner wire and said combination not to contact with each other when said combination part and said sheet are bended; in the meantime, said tag pairs are respectively caused to buckle said metal housing, said two arms and said a grounding wire layer and outer insulation layer of said coaxial cable, wherein a female terminal is disposed at the lower end of said central terminal, said male terminal is constituted by a plurality of contact sheets, wherein said central terminal comprises an upper end part and a lower end part; said upper part is positioned above said lower end part; said upper end part comprises a bottom sheet, a first sheet and a second sheet; said first sheet and said second sheet extend upward from two opposite sides of said bottom sheet; end parts of said first sheet and said second sheet are bent downward to form a first wall and a second wall respectively; a space between said first wall and said second wall forms said fixing groove and said guiding groove which communicated with each other and have certain depths.

4. A radio frequency microwave connector for telecommunication, used for allowing the manufacturing of the connector to be more time saving and a central terminal and an inner wire of a coaxial cable to be more tightly combined, comprising:

a metal housing, a combination part being extended upward from a upper end thereof, said combination cart having a intermediate element and a plurality of tag pairs respectively extended outward from two sides of said intermediate element, a pair of arms extended outward at the opposite sides of said combination being disposed on said metal housing, an interval existing between said two arms;

a plastic insulator, covered in said metal housing and having a hollow portion, a bendable sheet extended upward and a projection extended outward and levelly being disposed at a upper end thereof, said protection being accepted between said two arms, a groove is disposed on said projection, said sheet being corresponding to said groove;

the central terminal, covered in said hollow portion of said plastic insulator, a fixing groove and guiding groove communicated with each other being disposed at a upper end of said central terminal, said guiding groove being positioned above said fixing groove, one of a male terminal and a female terminal being disposed at a lower end of said central terminal;

wherein a diameter of a cross section of said guiding is larger than a diameter of said inner wire of said coaxial cable, a diameter of a cross section of a upper end of said fixing groove is smaller than said diameter of said inner wire; whereby, said inner wire is allowed to thrust into said fixing groove and a lower end of said insulating sheet to be placed in said groove and suppressed above said inner wire to cause said inner wire and said combination not to contact with each other when said combination part and said sheet are bended; in the meantime, said tag pairs are respectively caused to buckle said metal housing, said two arms and said a grounding wire layer and outer insulation layer of said coaxial cable, wherein a female terminal is disposed at the lower end of said central terminal, said male terminal is constituted by a plurality of contact sheets, wherein said central terminal comprises an upper end part and a lower end part; said upper end part is positioned above said lower end part; said upper end part comprises a bottom sheet, a first sheet and a second sheet; said first sheet and said second sheet extend upward from two opposite sides of said bottom sheet; end parts of said first sheet and said second sheet are bent downward to form a first wall and a second wall respectively; a groove hole is formed in middle parts of said first sheet and said second sheet; said two groove holes are respectively extended to end parts of said first wall and said second wall; said bottom sheet has holes for allowing bottoms of said first wall and said second wall to be respectively passed through; a space between said first wall and said second wall is forms fixing groove and said guiding groove which communicate with each other and have certain depths.

* * * * *